United States Patent [19]

Hannen

[11] 4,409,774

[45] Oct. 18, 1983

[54] EQUIPMENT FOR COVERING A STACK OF GOODS WITH A SHRINK-WRAP

[75] Inventor: Rainer Hannen, Goch, Fed. Rep. of Germany

[73] Assignee: MSK Verpackungs-Systeme GmbH, Kalkar-Wissel, Fed. Rep. of Germany

[21] Appl. No.: 218,213

[22] Filed: Dec. 19, 1980

[30] Foreign Application Priority Data

Dec. 19, 1979 [DE] Fed. Rep. of Germany ..... 2951086

[51] Int. Cl.[3] ..... B65B 43/46; B65B 43/60; B65B 57/00; B65B 59/02

[52] U.S. Cl. ..... 53/77; 53/64; 53/557; 53/567; 53/570

[58] Field of Search ..... 53/504, 77, 218, 64, 53/557, 66, 556, 570, 571, 567, 392, 255, 386, 256

[56] References Cited

U.S. PATENT DOCUMENTS

| | | | |
|---|---|---|---|
| 2,916,860 | 12/1959 | Sanford | 53/392 X |
| 2,939,259 | 6/1960 | Heckler | 53/370 X |
| 3,675,388 | 7/1972 | Lems | 53/570 |
| 3,707,064 | 12/1972 | Mucka et al. | 53/570 X |
| 3,738,079 | 6/1973 | Rudman et al. | 53/567 X |
| 3,902,303 | 9/1975 | King | 53/556 |
| 3,916,769 | 11/1975 | Turunen | 53/570 X |
| 4,078,358 | 3/1978 | Henderson | 53/386 X |

*Primary Examiner*—Horace M. Culver

*Attorney, Agent, or Firm*—Shlesinger, Arkwright, Garvey & Fado

[57] ABSTRACT

Equipment for covering a stack of goods with a shrink-wrap having a vertically displaceable lift carriage; guide means for said carriage; means for displacing said carriage; a substantially horizontal support connected to said carriage, said support rotateable substantially 180° around a vertically displaceable horizontal axis; means for rotating said horizontal support; and, shrink-wrap gripping and releasing means connected to said horizontal support and moveable therewith for placing said shrink-wrap around said goods is disclosed.

10 Claims, 2 Drawing Figures

EQUIPMENT FOR COVERING A STACK OF GOODS WITH A SHRINK-WRAP

The invention relates to equipment for covering a stack of goods with a shrink-wrap. Two driven support arms with clamps for holding the upper unfolded edge of the shrink-wrap are provided and are vertically moveable and are supported so as to be pivotable above the stack of goods.

In equipment of the same species (German Offenlegungsschrift No. 28 06 343), the free end of a length of tubular foil wound on a roll is seized by a device which unfolds the forward edge of the length of tubular foil and severs a section from it. At the same time a weld seam to complete the shrink wrap is formed. The two support arms, borne independently from each other in separate guides, then are moved vertically upward and pivoted, as a consequence of which the shrink wrap unfolds. Once the unfolded shrink wrap arrives with its open side above the stack of goods, the support arms moved downward and pull the shrink wrap over the stack of goods. After the clamps are released, the support arms can return to their initial position. The equipment known to this extent has been found practical. However it can be improved.

It is the object of the invention to simplify the design of equipment of the above cited species and to functionally improve said equipment.

The problem is solved by joining the support arms to a common support pipe itself borne in a displaceable lift-carriage having inside vertical guides. The support pipe is rotatable only to one side about an essentially horizontal axis.

The equipment of the invention allows a saving in bulk because the support pipe for the support arms is supported only on one side and accordingly a lift-carriage with associated guide means is required only on one side of said equipment. As a result a simpler and also more econmical design is achieved. This has the additional advantage that the equipment can be adapted without difficulties to variations in size, that is, it is possible to build the equipment at least in part as a module.

As a rule, it will suffice that the guide means for the lift-carriage consists of two mutually parallel tubes, especially cross-sectionally rectangular tubes, supporting the lift-carriage by means of rollers or the like made of steel, plastic or similar. Preferably rubber rollers are used to brace the lift-carriage in the guide tubes and thereby less noise is generated in operation. An appropriate embodiment of the invention is characterized in that the lift-carriage comprises a continuous recess for the guide tubes which are correspondingly encloded by the lift-carriage when seen in vertical projection.

In another embodiment of the invention the support pipe for the support arms, or its pivot bearing, can extend between the guide tubes and possibly beyond. An advantageous weight compensation or counter-balancing becomes possible in this manner.

Preferably the lift-carriage and the support pipe are driven in mutually independent manner. This does not exclude controlling the two drives in such a manner that the lift-carriage and the support-pipe are displaced simultaneously. The best embodiment for a particular case can be ascertained by simple tests. The essential object to be achieved is that the shrink wrap held by the support arms should completely unfold while being pivoted to a position above the stack of lump goods.

To adjust the equipment for different wrap sizes, the support arms should be mounted in adjustable manner on the support pipe. In particular the mutual spacing of the clamps around a center position should be variable in a uniform and simultaneous manner. Obviously, it is also necessary that the mutual spacing of the clamps on the support arms about a center position also be adjusted simultaneously and uniformly. this can be implemented by using worm drives, gear rack drives and the like.

A light sensor may be provided to detect the height of the stack of goods and to control the equipment. The detector may be mounted underneath the axis of rotation of the lift-carriage. It is possible by means of this light detector to control the motion of the lift-carriage so that the shrink wrap—after the rotation has taken place—will be accurately positioned above the upper edge of the stack of goods. During the ensuing lowering of the support arms, the air is forced into the shrink wrap and damage to the shrink wrap is prevented. Simultaneously, a uniformly smooth apposition of the shrink wrap against the surfaces of the stack of goods is achieved.

Moreover, light-barrier means may be provided to secure the operational range of the pivoting support arms. Additionally, a contacting plate to shut off the drive upon being loaded can be mounted within the operational range of the pivoting support arms in order to prevent personal injury due to the moving support arms.

An embodiment of the invention shown in the drawing is discussed below.

The equipment shown is used to cover stacks of goods 29 delivered by a roller conveyor 60 with shrink wrap 43. The shrink wrap 43 is formed of segments taken from a length of tubular foil stored on an (omitted) roll. Another apparatus for the take off, stopping and severing or welding of the shrinking hoods is disclosed in German Offenlegungsschrift No. 28 06 343. However, the equipment disclosed can operate with finished shrink wraps.

Figure 1:
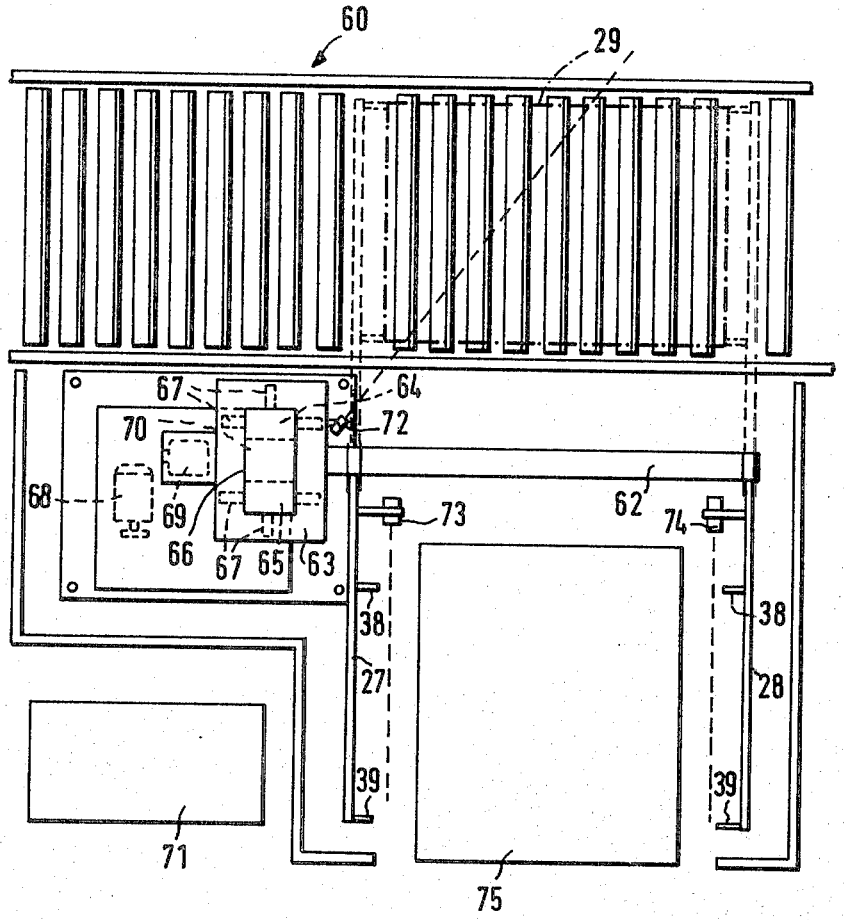
FIG. 1 is a schematic topview of equipment for covering a stack of goods with a shrink wrap.
Figure 2:
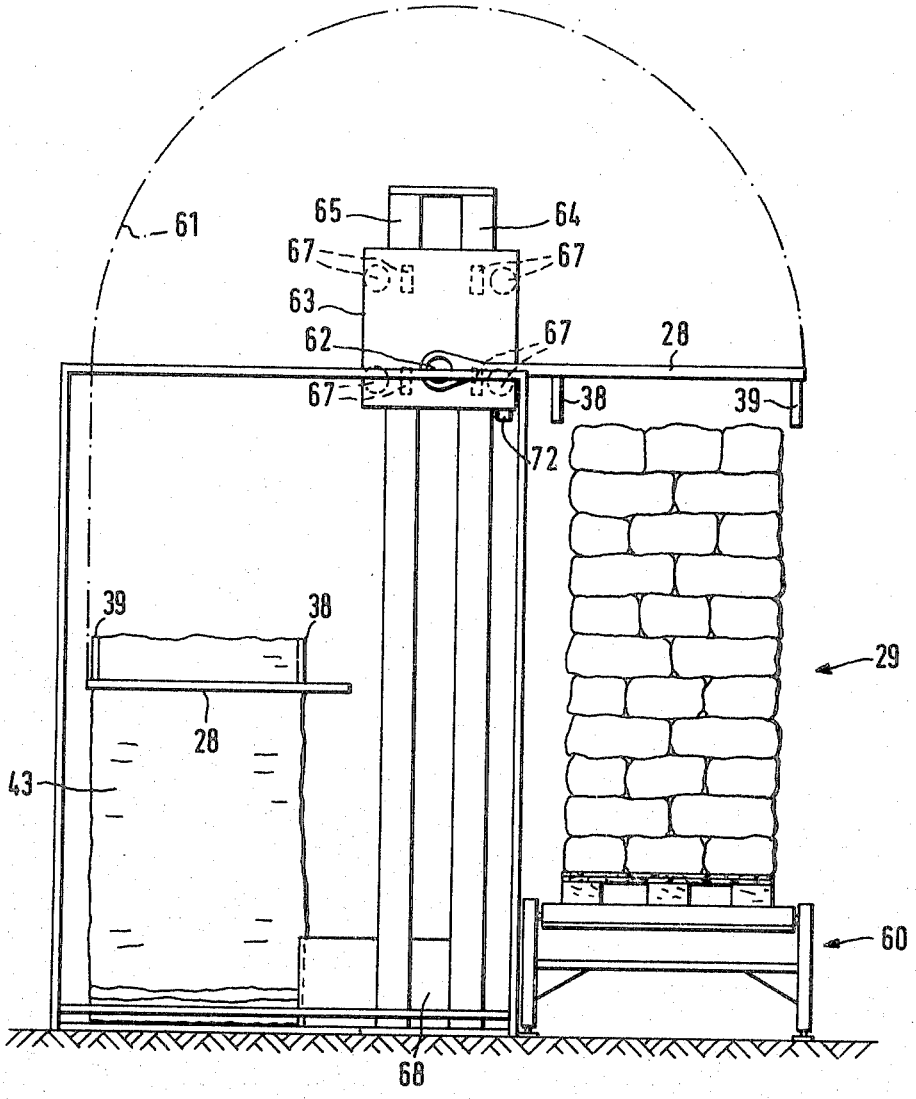
FIG. 2 is a schematic side view of the embodiment of FIG. 1.

In any event, the shrink wrap 43 is seized along the upper unfolded edges by clamps 38, 39 connected to two support arms 27, 28. The clamps are guided upwards along the dot-dashed line 61 indicated in FIG. 2, and are pivoted approximately 180° until positioned above the stack of goods 29 and finally pulled over the stack of goods 29.

The two support arms 27, 28 are mounted on support pipe 62 of which one end is borne in a lift-carriage 63 which is braced, guided and vertically movable between two parallel vertical rectangular tubes 64, 65.

To adapt to different wrap sizes, the support arms 27, 28 are mounted in adjustable manner on the support pipe 62. They can be uniformly and simultaneously displaced with respect to a center position by a device not shown in detail, for instance by a worm drive, a gear rack drive or the like. Similar considerations hold for the arrangement of the clamps 38, 39 on the support arms 27 and 28. Furthermore, the clamps 38, 39 are designed and built as disclosed in the German patent application P No. 28 43 122.8. Where appropriate, the clamps may be actuated electrically instead of pneumatically, whereby only one compressed-air line or electric power line and the required control lines to the lift carriage 63 need be provided. The actuating members may be mounted on the lift carriage itself.

In the embodiment shown, the lift carriage 63 has a box-like shape and a continuous inside clearance 66 for the two mutually spaced rectangular tubes 64, 65, mounted therein. Several rubber rollers are mounted within the lift-carriage 63, and rest against the external faces of the rectangular tubes 64, 65 and guide the lift-carriage 63 in its vertical motion. As electric motor 68 transmits its drive energy by means of an omitted chain drive or the like to the lift carriage 63; said motor is mounted at the lower ends of the rectangular tubes 64, 65.

Should the entire drive system for the lift carriage 63 be mounted between the rectangular tubes 64, 65, the equipment dimensions may be reduced, whereby a fork-lift can deposit pallets loaded with the stacked goods directly opposite the lift carriage and onto the roll conveyor 60. For reasons of safety, the lift carriage should be moved by two chains and the drive sprocket wheels should be equipped with safety pawls.

The pivoting drive for the support arms 27, 28, i.e. the support pipe 62, is independent of the lift-carriage drive. An electric motor 69 is connected to the lift-carriage 63 on the side away from the support pipe 62 and in the vicinity of the pivot bearing 70 of the support pipe 62. The pivot bearing 70 of the support pipe arm 62 extends through the clearance 66 of the lift-carriage 63 in the embodiment shown in the drawing.

A control system 71 with a switching panel may be used to control the drives 68, 69. This control system 71 may also process the data from a light sensor 72 mounted on the lift carriage below the axis of rotation of the support pipe 62. The light sensor 72 is directed and connected that it will stop the motion of the lift carriage 63 when the shrink wrap 43 opening has been rotated above the stack of goods 29 and is aligned with the upper edge of the stack of goods. This procedure offers advantages regarding the air caught when the shrink wrap 43 is pulled down.

The drawing omits a guide track having tubes to guide the shrink wrap 43 during rotation and connected to the lift carriage 63. This guide track is intended to prevent the shrink wrap from tipping over outwardly during rotation.

Also, to increase safety, light barriers 73, 74 are provided in the operational region swept by the support arms 27, 28, whereby the drive will be shut off the moment a person enters said operational region. Additionally, a contact-plate 75 is mounted in the operational region which will shut off the drives when being loaded.

It is clear that the equipment shown may be intergrated with the described components into a modular system because the support arms 27, 28 are connected to a common support pipe 62 which is supported only on one side. Simple and easy adaptation to various wrap sizes furthermore is made possibly by the adjustability of the support arms and their clamps.

I claim:

1. Equipment for covering a stack of goods with a shrink-wrap, comprising:

a. a vertically displaceable lift carriage;

b. guide means for said carriage;

c. means for vertically displacing said carriage;

d. a substantially horizontal support connected to said carriage, said support rotatable substantially 180° around a vertically displaceable horizontal axis coincident with said support;

e. means for rotating said horizontal support; and, f. shrink-wrap gripping and releasing means connected to said horizontal support and displaceable and rotatable therewith for transferring said shrink-wrap from a first position on one side of said guide means to a second position on an opposed side of said guide means.

2. Equipment for coveriing a stack of goods with a shrink wrap as defined in claim 1, wherein:

a. said guide means include at least one rectangular guide tube; and, b. roller means connected to said carriage for contacting said guide tube.

3. Equipment for covering a stack of goods with a shrink wrap as defined in claim 2, wherein:

a. said roller means include rubber rollers.

4. Equipment for covering a stack of goods with a shrink wrap as defined in claim 2, further comprising:

a. an aperture in said lift carriage for allowing said guide means to pass through said carriage.

5. Equipment for covering a stack of goods with a shrink wrap as defined in claims 1 or 2 further comprising:

a. at least two rectangular guide tubes; and, b. a pivot bearing on said horizontal support arm positioned between said guide tubes.

6. Equipment for covering a stack of goods with a shrink wrap as defined in claim 1, wherein:

a. said lift carriage displacement means and said horizontal support rotating means operate independent of one another.

7. Equipment for covering a stack of goods with a shrink wrap as defined in claim 1, further comprising:

a. a light sensor mounted to said carriage beneath the horizontal axis of said horizontal support for detecting the height of the stack of goods and controlling the displacement of said lift carriage.

8. Equipment for covering a stack of goods with a shrink wrap as defined in claim 1, further comprising:

a. light barriers for detecting the presence of personnel in the area throughout which said arms may move.

9. Equipment for covering a stack of goods with a shrink wrap as defined in claim 1, further comprising:

a. a load activated contact plate for shutting off said lift carriage displacement means and said horizontal support rotating means.

10. Equipment for covering a stack of goods with a shrink wrap as defined in claims 1 or 2, wherein:

a. said lift carriage displacement means is mounted between said guide means at substantially said lift carriage center of gravity.

* * * * *